US012791016B2

(12) United States Patent
Song et al.

(10) Patent No.: US 12,791,016 B2
(45) Date of Patent: Nov. 10, 2026

(54) RECIPROCATING COMPRESSOR WITH DAMPERS

(71) Applicant: LG ELECTRONICS INC., Seoul (KR)

(72) Inventors: Kiwook Song, Seoul (KR); Kihun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 19/368,171

(22) Filed: Oct. 24, 2025

(65) Prior Publication Data

US 2026/0185512 A1 Jul. 2, 2026

(30) Foreign Application Priority Data

Dec. 31, 2024 (KR) ..... 10-2024-0202884

(51) Int. Cl.
*F04B 39/00* (2006.01)
*F04B 39/12* (2006.01)

(52) U.S. Cl.
CPC ..... *F04B 39/00* (2013.01); *F04B 39/0027* (2013.01); *F04B 39/122* (2013.01)

(58) Field of Classification Search
CPC .... F04B 53/003; F04B 39/0044; F04B 35/04; F16F 2230/0041
See application file for complete search history.

(56) References Cited

U.S. PATENT DOCUMENTS 6,296,237 B1 * 10/2001 Nagai ..... F16F 9/58 267/140
2018/0087494 A1 * 3/2018 Brune ..... F04B 17/03
2022/0056897 A1 * 2/2022 Cho ..... F16F 1/128

FOREIGN PATENT DOCUMENTS

CN 110925165 A * 3/2020 ..... F04B 39/14
EP 3 283 767 9/2018
EP 3 477 109 5/2019
EP 3 730 789 10/2020
WO WO 2017/137328 8/2017
WO WO 2022/039555 2/2022
WO WO-2022039555 A1 * 2/2022 ..... F04B 39/0044

OTHER PUBLICATIONS

European Search Report issued in Application No. 25225507.0 dated Mar. 23, 2026.

* cited by examiner

*Primary Examiner* — Thomas Fink
(74) *Attorney, Agent, or Firm* — KED & ASSOCIATES

(57) ABSTRACT

A reciprocating compressor provided with a damper is disclosed. The compressor includes a fastening member that fastens a stator and a cylinder block. The fastening member may be named a stator bolt. The compressor further includes a damper. The damper is press-fitted into and coupled to an insertion portion of the fastening member protruding from an upper surface of the cylinder block. Through this, the damper may protect a compressor body from external impact by avoiding a drive motor and a compression unit, which are the compressor body, from directly colliding with a housing due to a vibration generated during the operation of the compressor.

16 Claims, 12 Drawing Sheets

RECIPROCATING COMPRESSOR WITH DAMPERS

CROSS-REFERENCE TO RELATED APPLICATION

Pursuant to 35 U.S.C. § 119(a), this application claims the benefit of the earlier filing date and the right of priority to Korean Patent Application No. 10-2024-0202884, filed on Dec. 31, 2024, the contents of which are incorporated by reference herein in their entirety.

BACKGROUND

1. Field

The present disclosure relates to a reciprocating compressor with dampers that can protect a main body inside a housing from external impact.

2. Description of the Related Art

A compressor is a device provided with a motor unit and a compression unit to compress refrigerant that has passed through a refrigeration and air conditioning device such as a refrigerator or air conditioner, and transmit the compressed refrigerant to a condenser.

The compressor may be divided into open and closed types depending on its closed construction.

A closed compressor accommodates a motor unit and a compression unit within a single, completely closed housing (also called a "housing").

The compressor may be classified into reciprocating, rotary, vane, and scroll types according to a method of compressing the refrigerant.

The compression unit of a reciprocating compressor includes a piston and a connecting rod. The piston reciprocates inside a cylinder block. The connecting rod converts a rotational motion of a crankshaft, which is pressed into a rotor, into a linear motion.

The piston may receive power from the connecting rod to compress the refrigerant stored in the cylinder block to a preset pressure.

Prior art patent document EP 3730789 A1 (published on Oct. 28, 2020; hereinafter, referred to as patent document 1) discloses a refrigerant compressor.

According to patent document 1, a reciprocating refrigerant compressor includes a block provided inside a housing, a protruding portion protruding from an upper side of the block, and a damper surrounding the protruding portion.

The damper may serve to prevent and buffer a collision between the protruding portion and the housing due to a vibration of the block when the compressor is driven.

There are two dampers each at front and rear sides of the block. The front and rear dampers are connected to an upper end of a drive unit. An inner surface of the housing is provided with an upper contact portion, front and rear contact portions, and side contact portions in contact with the damper.

The upper contact portion, front and rear contact portions and side contact portions of the housing are respectively arranged parallel to an outer surface of the damper.

Prior art patent document EP 3283767 B1 (published on Sep. 26, 2018; hereinafter, referred to as patent document 2) discloses a refrigerant compressor.

According to patent document 2, the refrigerant compressor includes a damping device to reduce noise. The damping device includes an outer element and an inner element. The outer element is configured to surround the inner element.

The inner element is connected to a drive device. The inner element is configured to support the damping device.

The outer element is formed of a material such as rubber to perform a damping function to alleviate impact when colliding with the inner element.

However, the inner elements are coupled to each other by passing through the cylinder block without passing through a stator.

In the case of a structure in which the inner element passes through only the cylinder block, a diameter of the cylinder block must be larger than that of the stator, or the cylinder block must have a structure that surrounds the stator, so there is a problem in that a diameter (size) of the compressor increases.

In addition, there is a disadvantage in that a number of components increases because a separate inner element is required to support the damping device.

SUMMARY

An aspect of the present disclosure is to provide a reciprocating compressor provided with a damper having a structure that can solve the foregoing problems.

A first aspect is to provide a reciprocating compressor provided with a damper having a structure that does not require a separate component to support the damper.

A second aspect is to provide a reciprocating compressor provided with a damper having a structure that can reduce costs.

A third aspect is to provide a reciprocating compressor provided with a damper having a structure that can minimize a number of components.

A fourth aspect is to provide a reciprocating compressor provided with a damper having a structure that can prevent disengagement due to impact during use.

A fifth aspect is to provide a reciprocating compressor provided with a damper having a simple structure.

As a result of intensive research, the inventors of the present disclosure have found that the first to fourth aspects of the present disclosure may be achieved by the following embodiments of the present disclosure.

In order to achieve the foregoing objectives, a compressor according to the present disclosure may include a housing; a motor unit provided on an inner side of the housing, and provided with a crankshaft, a rotor coupled to the crankshaft, and a stator surrounding the rotor; a compression unit including a cylinder block provided on the inner side of the housing, a piston disposed to be reciprocally movable inside the cylinder block, and a connecting rod connected to the crankshaft and the piston; a fastening member coupled to the stator to pass through the cylinder block; and a damper mounted on one end portion of the fastening member protruding from the cylinder block.

Through this, the damper may be fixed to an end portion of a part of the stator fastening member that fastens the existing stator to the cylinder block with an extended length so as not to require a separate component for fixing the damper, thereby minimizing a number of components.

According to one example, the fastening member may be formed of an iron-based material. The damper may be formed of a rubber material.

Through this, the fastening member may improve the support strength of the damper. The damper may protect a compressor body, for example, the compression unit and the motor unit, from external impact.

According to one example, the fastening member may be implemented as a screw.

Through this, the assembly of the damper is facilitated.

According to one example, the damper may be arranged to be spaced apart from an inner side surface of the housing by a preset distance in at least one of up-down, front-rear, and left-right directions.

Through this, the damper may alleviate impact even if it collides with the housing due to a vibration generated during the operation of the compressor.

According to one example, the damper may be a rear damper disposed on a rear side of the cylinder block in a direction away from the piston that moves such that refrigerant sucked into a compression chamber of the cylinder block is compressed.

Through this, the damper may attenuate external impact when there is a collision between a rear side of the cylinder block and a rear side of the housing.

According to one example, the housing may include a first housing; and a second housing coupled to cover an upper portion of the first housing.

The fastening member may protrude upward from one surface of the cylinder block. A height of the damper protruding from one surface of the cylinder block may be greater than or equal to a distance between an upper surface of the damper and an inner side surface of the housing.

Through this, the damper may be prevented from being removed by external impact by being caught on the housing even if a press-fitting surface for the fastening member becomes loose.

According to one example, an insertion portion may be provided at one end portion of the fastening member protruding from the cylinder block.

A receiving portion may be disposed inside the damper into which the insertion portion is press-fitted.

Through this, the insertion portion may be inserted into the receiving portion to induce press-fit coupling between the damper and the fastening member.

According to one example, the fastening member may further include a chamfer disposed to be inclined at an end portion of the insertion portion.

The damper may further include a buffer space portion to surround the chamfer at a distance therefrom.

Through this, the chamfer may minimize the damper from being torn by impact from an edge of the fastening member. The buffer space portion may provide a space in which the fastening member can further move into the damper, thereby maximizing a buffering action of the damper.

According to one example, the buffer space may include an inclined portion in close contact with at least one side surface of the chamfer.

Through this, the damper may relatively move along an inclined direction while in contact with an end edge of the fastening member through the inclined portion to alleviate impact.

According to one example, a stress distribution hole may be disposed at an upper portion of the damper so as to pass through toward the receiving portion.

Through this, the stress distribution hole may distribute the stress of the damper when the damper and the fastening member are compressed.

According to one example, an anti-separation groove may be disposed around the cylinder block from which the fastening member protrudes.

An anti-separation protrusion may protrude from one surface of the damper in close contact with the cylinder block to be coupled to the anti-separation groove.

Through this, the anti-separation protrusion may be inserted into and coupled to the anti-separation groove, thereby limiting the damper from being separated from the cylinder block.

According to one example, a first tapered portion may be disposed on an outer peripheral surface of the anti-separation protrusion to be inclined toward an inner side of the anti-separation groove. A second tapered portion may be disposed on an inner peripheral surface of the receiving portion to have a diameter that decreases toward the anti-separation groove.

Through this, the first tapered portion may be guided to be inserted into and coupled to the anti-separation groove. The second tapered portion may form a two-stage press-fit with the receiving portion (one-stage press-fit) for the fastening member.

According to one example, the fastening member may include a first fastening member passing through the stator to be fastened to a part of an inner side of the cylinder block; and a second fastening member disposed on the same line as the first fastening member and press-fitted into and coupled to another part of the inner side of the cylinder block.

The damper may be coupled to the second fastening member.

Through this, the second fastening member is a separate connecting structure for fastening the damper to the cylinder block, but the fastening and assembly of the damper is facilitated.

According to one example, the damper and the second fastening member may be made of different materials, and integrally coupled to each other.

Through this, the damper and the second fastening member may be integrally manufactured and then assembled by pressing them into the cylinder block.

According to one example, a coupling protrusion may be disposed to protrude radially from an inner peripheral surface of the damper.

A coupling groove may be disposed to be recessed on an outer peripheral surface of the fastening member so as to be coupled to the coupling protrusion.

Through this, the coupling protrusion of the damper and the coupling groove of the fastening member may be mated with each other, thereby preventing the damper from being disengaged.

According to another example, a coupling groove may be disposed to be radially recessed on an inner peripheral surface of the damper.

A coupling protrusion may be disposed to protrude from an outer peripheral surface of the fastening member so as to be coupled to the coupling groove.

Through this, the coupling groove of the damper and the coupling protrusion of the fastening member are mated with each other, thereby preventing the damper from being disengaged.

According to an embodiment of the present disclosure, the following effects may be achieved.

First, a fastening member may fasten a stator of a motor unit and a cylinder block of a compression unit. The fastening member may be implemented as a bolt. The bolt that connects the stator and the cylinder block may be named a stator bolt. One bolt may pass through the stator and cylinder block to be coupled to each other. The fastening member may be an iron-based material.

One end portion of the fastening member may protrude from one surface of the cylinder block. A damper may be press-fitted into and coupled to one end portion of the protruding fastening member. Through this, the damper may be press-fitted into and coupled to a stator fastening member that is further extended to protrude from one surface of the cylinder block, so as to be fixed to an existing stator fastening member without a separate component.

The damper may be made of an elastic material such as rubber. One end portion of the fastening member may form an insertion portion that is inserted into the damper. A receiving portion is disposed inside the damper so as to allow the insertion portion to be received into the damper. The receiving portion may have a diameter equal to or slightly smaller than the insertion portion. The receiving portion of the damper may be press-fitted into and coupled to the insertion portion.

Through this, the damper may be directly assembled to the fastening member without a separate connection structure. The damper may protect the compressor body from external impact by avoiding a drive motor and a compression unit, which are the compressor body, from directly colliding with a housing due to a vibration generated during the operation of the compressor.

Second, the damper may be disposed to be spaced apart from an inner side surface of the housing of the compressor by a gap. A lower surface of the damper may be in close contact with an upper surface of the cylinder block, and the damper may extend to protrude upward from the upper surface of the cylinder block. A height of the damper may be greater than a distance between an upper surface of the damper and an upper side of the inner side surface of the housing.

Through this, even if a press-fit between the damper and the fastening member is released due to a collision between the damper and the housing or other reasons, the damper may be caught on an upper side of the housing, thereby preventing the damper from being removed.

Third, an anti-separation protrusion may be dispose on the lower surface of the damper to protrude toward the cylinder block. An anti-separation groove may be disposed to be recessed into the upper surface of the cylinder block. The anti-separation protrusion may be inserted into and coupled to the anti-separation groove.

Through this, the anti-separation protrusion is coupled to the anti-separation groove, thereby preventing the damper from being separated from the upper surface of the cylinder block due to a vibration generated during the operation of the compressor.

Fourth, a first tapered portion may be disposed to be inclined on an outer peripheral surface of the anti-separation protrusion. Through this, the first tapered portion may induce a tight coupling between the lower surface of the damper and the upper surface of the cylinder block.

Fifth, a second tapered portion may be disposed to be inclined radially inward on an inner peripheral surface of the receiving portion of the damper. Through this, the second tapered portion may induce a two-stage press-fit coupling with the receiving portion when the insertion portion of the fastening member is received into the receiving portion of the damper. For example, a diameter of the receiving portion may be slightly smaller than that of the fastening member to induce a one-stage press-fit, and a diameter of the second tapered portion may be smaller than that of the receiving portion to induce a two-stage press-fit due to a difference in diameter with the fastening member.

Sixth, a coupling protrusion may be disposed on an inner peripheral surface of the receiving portion of the damper to protrude radially inward. A coupling groove may be disposed on an outer peripheral surface of the fastening member to be recessed radially inward. Alternatively, the coupling groove may be disposed on an inner peripheral surface of the receiving portion of the damper to be recessed radially outward. A coupling protrusion may be disposed on the outer peripheral surface of the fastening member to protrude radially outward.

Through this, the coupling protrusion may be coupled to the coupling groove, thereby minimizing the damper from being separated from the fastening member.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Hereinafter, a reciprocating compressor provided with a damper according to an embodiment of the present disclosure will be described in detail with reference to the accompanying drawings.

In the following description, descriptions of some elements may be omitted to clarify the features of the present disclosure.

1. Definition of Terms

The terms including an ordinal number such as first, second, and the like may be used to describe various elements, but the elements should not be limited by those terms. The terms are used merely for the purpose to distinguish one element from another element.

It should be understood that when an element is referred to as being "connected to" or "coupled to" another element, the element may be directly connected to or coupled to the other element or intervening elements may also be present. On the contrary, it should be understood that when an element is referred to being "directly connected" or "directly coupled" to another element, there are no intervening elements present.

A singular expression used herein may include a plural expression unless clearly defined otherwise in the context.

The term "radial" as used in the following description refers to a shape that extends out in all directions from a central point like spokes of a wheel.

The term "axial direction" as used in the following description refers to a longitudinal direction of a crankshaft.

The term "axial direction" as used in the following description may refer to an up-down direction.

The term "radial direction" as used in the following description, refers to a longitudinal direction of a line segment from the center of a circle or cylinder to a point on a circumference.

The term "circumferential direction" as used in the following description refers to a direction of circumference of a circle.

The term "crankshaft" as used in the following explanation, which is a shaft that converts rotational motion into linear motion, refers to a shaft mainly used to move a piston.

The term "journal" as used in the following description refers to a shaft part supported by bearings or the like.

2. Description of Configuration of Compressor According to One Embodiment of Present Disclosure In this embodiment, a compressor may be applied to a closed compressor.

In this embodiment, a compressor may be applied to a reciprocating compressor. However, the present disclosure is not limited thereto.

Figure 1:
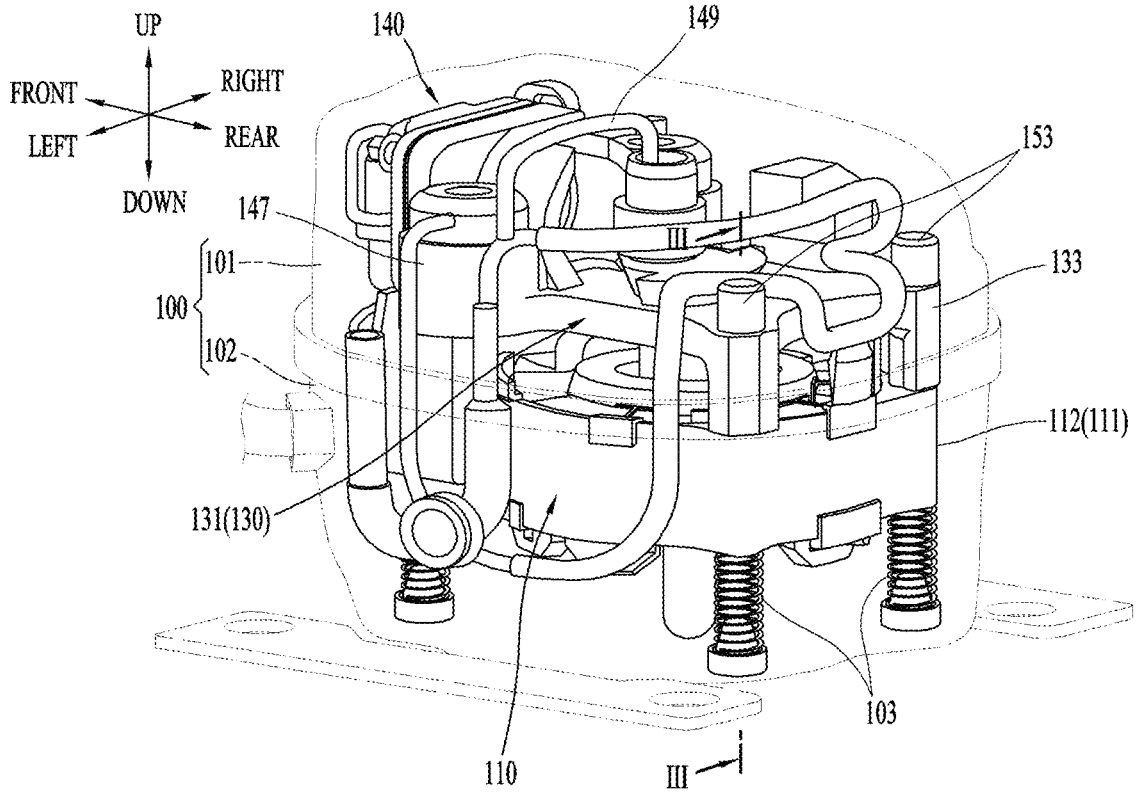
FIG. 1 is a perspective view showing a compressor according to one embodiment of the present disclosure.

FIG. 1 is a perspective view showing a compressor according to one embodiment of the present disclosure.

Figure 2:
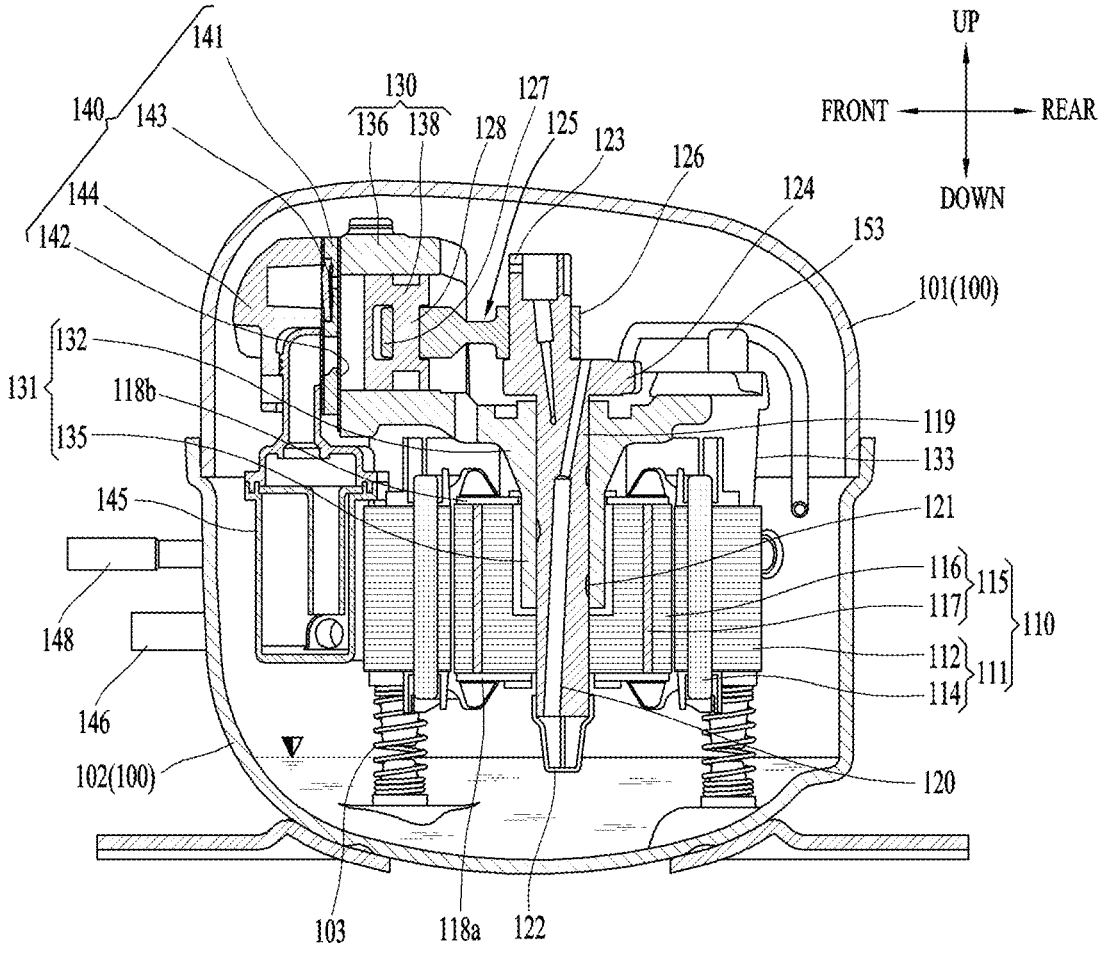
FIG. 2, which is a cross-sectional view of the compressor in FIG. 1, is a conceptual view showing an internal element of the compressor.

FIG. 2, which is a cross-sectional view of the compressor in FIG. 1, is a conceptual view showing an internal element of the compressor.

Figure 3:
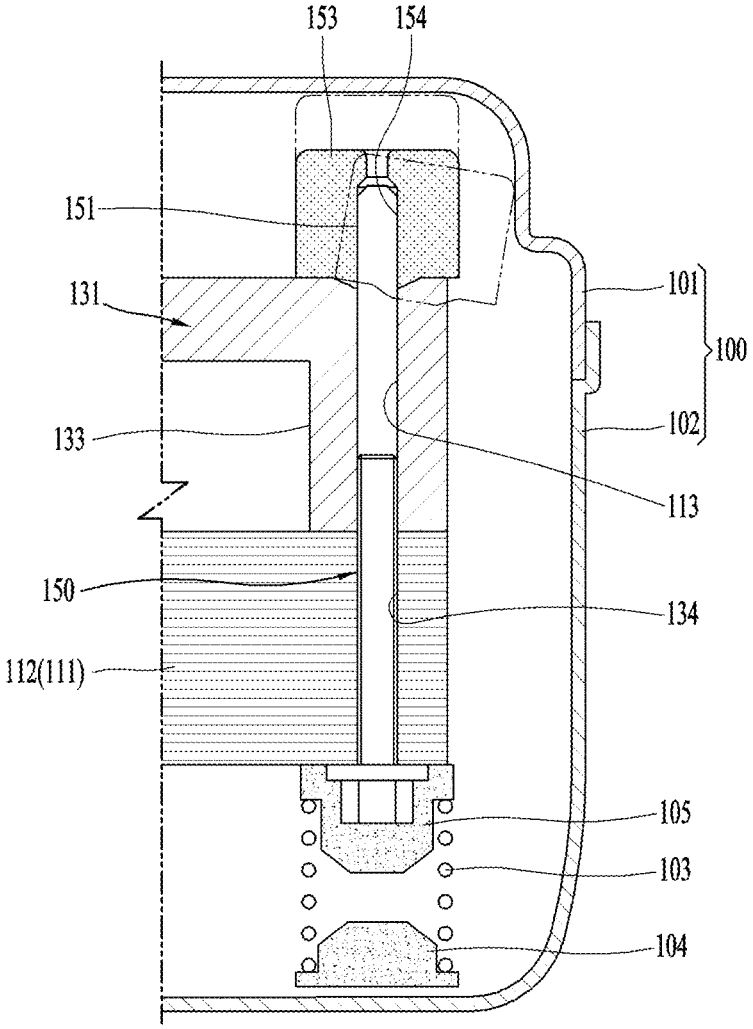
FIG. 3, which is a cross-sectional view taken along III-III in FIG. 1, is a conceptual view showing a state in which a damper moves in up-down and front-rear directions toward an inner side surface of a housing during the movement of a cylinder block.

FIG. 3, which is a cross-sectional view taken along III-III in FIG. 1, is a conceptual view showing a state in which a damper 153 moves in up-down and front-rear directions toward an inner side surface of a housing 100 during the movement of a cylinder block 131.

Figure 4:
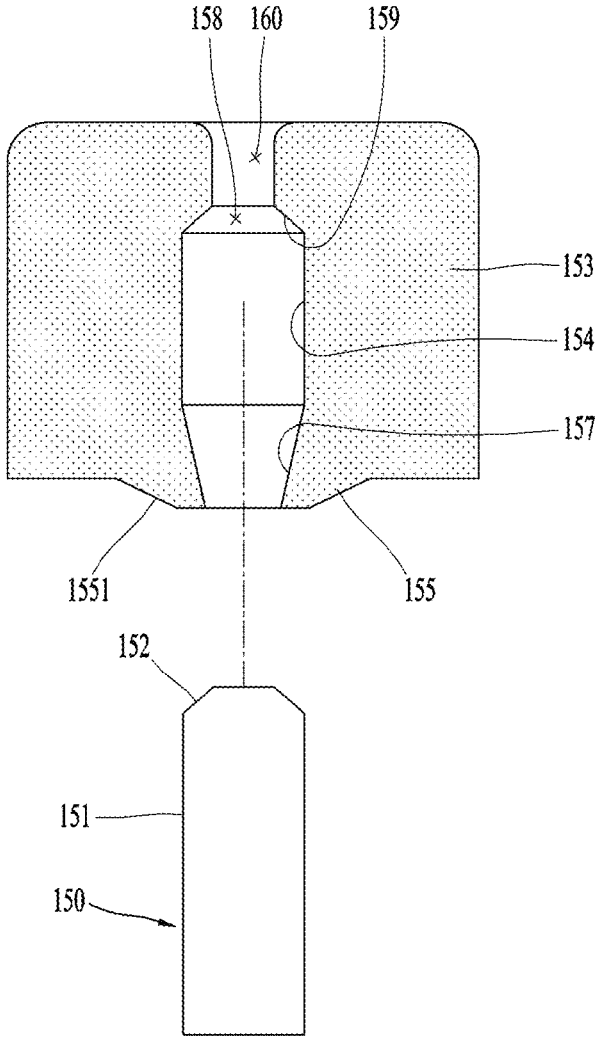
FIG. 4 is an exploded view of a damper and a fastening member in FIG. 3.

FIG. 4 is an exploded view of the damper 153 and a fastening member 150 in FIG. 3.

Figure 5:
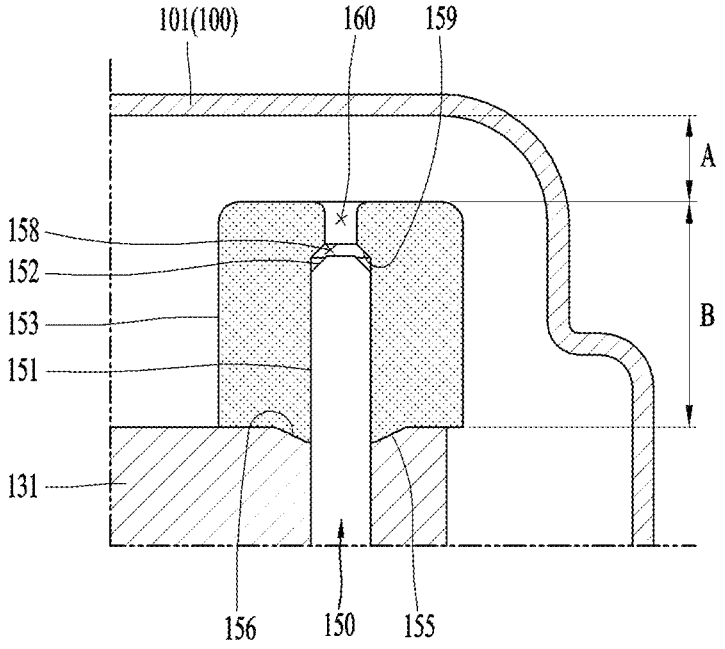
FIG. 5 is a conceptual view showing a state in which a height of the damper in FIG. 4 is greater than a distance between an upper surface of the damper and an inner side surface of the housing.

FIG. 5 is a conceptual view showing a state in which a height B of the damper 153 in FIG. 4 is greater than a distance between an upper surface of the damper 153 and an inner side surface of the housing 100.

A compressor according to this embodiment may be configured to include a housing 100, a compression unit 130, and a motor unit. The motor unit may be implemented as a drive motor 110.

The housing 100 constitutes an exterior of the compressor. A receiving space is provided inside the housing 100. The receiving space of the housing 100 may be configured to be sealed.

The compression unit 130 and the drive motor 110 may be received into the housing 100.

The housing 100 may include a lower housing 102 and an upper housing 101.

The lower housing 102 may be configured in a semi-cylindrical or hemispherical shape. The lower housing 102 is disposed below the upper housing 101. The lower housing 102 may be disposed to be opened upward. The lower housing 102 may be named a first housing.

The upper housing 101 is coupled to cover an upper portion of the lower housing 102. The upper housing 101 may be named a second housing.

Through this, the upper housing 101 and the lower housing 102 may seal the receiving space of the housing 100.

The drive motor 110 may include a stator 111 and a rotor 115.

The stator 111 may be received into the receiving space of the housing 100. The stator 111 may be elastically supported on a bottom surface of the lower housing 102.

For example, the stator 111 may be elastically supported by a spring 103. An elastic support element for elastically supporting a lower portion of the stator 111 may include a spring 103, a first support portion 104, and a second support portion 105.

The spring 103 may be configured with a coil spring. The first support portion 104 may be provided fixedly on a bottom surface of the lower housing 102. The first support portion 104 may be disposed in a cylindrical shape. A first flange portion protruding radially to support a lower end portion of the spring 103 may be provided on an outer peripheral portion of the first support portion 104.

The second support portion 105 may be provided fixedly on a lower surface of the stator 111. The second support portion 105 may be configured to surround a head portion of the fastening member 150 to be described later. A receiving groove that receives the head portion of the fastening member 150 may be further provided inside the second support portion 105.

A second flange portion protruding radially to support an upper end portion of the spring 103 may be provided on an outer peripheral portion of the second support portion 105.

Through this, the spring 103 may elastically support the stator 111. The spring 103 may prevent a vibration generated during the operation of the compressor from being directly transmitted to the housing 100.

The rotor 115 may be rotatably provided on an inner side of the stator 111.

The stator 111 may include a stator core 112 and a stator coil 114.

The stator core 112 may be formed by stacking and coupling a plurality of electrical steel sheets. The stator core 112 may be disposed in a square shape.

The stator core 112 may be configured with a back yoke, a plurality of teeth, and a plurality of slots. The back yoke may be disposed in a circular ring shape.

The teeth may be configured to protrude radially from an inner side surface of the back yoke. The slots may be disposed to pass through the stator 111 along an axial direction.

The plurality of teeth may be alternately disposed with a plurality of slots in a circumferential direction. A pole shoe may be provided at an inner end portion of the teeth. The pole shoe may be disposed to protrude on both sides along a circumferential direction from the inner end portion of the teeth. A radial thickness of the pole shoe may be disposed between outer and inner side surfaces of the pole shoe in a radial direction.

The stator coil 114 may be wound on the stator core 112 through the slots.

The stator core 112 may be fixed to a lower surface of the cylinder block 131 by the fastening member 150. The fastening member 150 may be implemented as a bolt or screw.

The fastening member 150 may pass through the stator core 112 and the cylinder block 131 to be described later so as to be coupled thereto.

A first through hole 113 may be disposed at an inside of the stator core 112 to pass therethrough. A second through hole 134 may be disposed at an inside of the cylinder block 131 to pass therethrough. The fastening member 150 may pass through the first through hole 113 and the second through hole 134.

Alternatively, the fastening member 150 may pass through the first through hole 113, and a part of the fastening member 150 may be received into the second through hole 134 without passing through the second through hole 134.

In this embodiment, it shows a state in which the fastening member 150 protrudes upward from an upper surface of the cylinder block 131 by passing through the first through hole 113 and the second through hole 134.

A plurality of fastening members 150 may be provided to fasten the stator core 112 and the cylinder block 131. For example, the plurality of fastening members 150 may be fastened in a total of four, two each at front and rear sides of the stator core 112 and the cylinder block 131. The plurality of fastening members 150 may be disposed to be spaced apart in front-rear and left-right directions.

A rotor receiving hole may be disposed at an inside of the stator core 112 along an axial direction. The rotor receiving hole may be disposed in a cylindrical shape. The stator 111 may be configured to surround the rotor 115. The rotor 115 may be received into a rotor receiving hole of the stator core 112.

The rotor 115 may include a rotor core 116 and a plurality of permanent magnets or a plurality of rotor bars 117. In this embodiment, it shows a state in which the plurality of rotor bars 117 are mounted on an inner side of the rotor core 116.

The rotor core 116 may be formed by stacking and coupling a plurality of electrical steel sheets. The rotor core 116 may be disposed in a cylindrical shape.

A first shaft hole may be disposed at the center of the rotor core 116 to pass axially therethrough. The first shaft hole may be located below the rotor core 116. A lower portion of the rotor core 116 may be press-fitted into and coupled to at least a part of the crankshaft 119 through the first shaft hole.

The crankshaft 119 may be coupled to the rotor core 116 through the first shaft hole.

A rotor bar receiving hole may be disposed on an inner side of the rotor core 116 to pass therethrough along an axial direction. The rotor bar 117 may extend in an axial direction. The rotor bar 117 may be formed of a conductor such as aluminum or an aluminum alloy.

The rotor bar 117 may be axially inserted and coupled into the rotor core 116 through the rotor bar receiving hole. The plurality of rotor bars 117 may be disposed to be spaced apart along a circumferential direction of the rotor core 116.

End rings 118*a*, 118*b* may extend in a circumferential direction. The end rings 118*a*, 118*b* may prevent the rotor bar 117 from being axially separated from the rotor bar receiving hole. A first end ring 118*a* may be coupled to a lower side of the rotor core 116. A second end ring 118*b* may be coupled to an upper side of the rotor core 116.

Through this, when external power is applied to the stator coil 114, a magnetic field may be formed around the stator coil 114. The rotor 115 may rotate by an electromagnetic interaction with the stator 111. The drive motor 110 may generate power for a reciprocating motion of the compression unit 130.

An eccentric shaft 123 is provided at an upper end portion of the crankshaft 119. The eccentric shaft 123 may be disposed eccentrically to one side in a radial direction from an upper portion of the crankshaft 119. A counterweight 124 may be disposed to protrude radially outward from the upper portion of the crankshaft 119. The eccentric shaft 123 may protrude upward from one side of the counterweight 124.

The counterweight 124 may be disposed at an upper end portion of the crankshaft 119 toward an opposite direction to the eccentric shaft 123 with respect to the crankshaft 119. The counterweight 124 may be a weight. Through this, the counterweight 124 may balance the center of rotation with respect to the eccentric shaft 123 based on the crankshaft 119.

A connecting rod 125 may be disposed between the drive motor 110 and the compression unit 130. The connecting rod 125 is configured to convert a rotational motion of the drive motor 110 into a reciprocating motion of the compression unit 130.

An eccentric shaft coupling portion 126 may be disposed in a ring shape at one end portion of the connecting rod 125. The eccentric shaft coupling portion 126 may be surrounded around the eccentric shaft 123. The eccentric shaft 123 may be received into the eccentric shaft coupling portion 126 to allow the eccentric shaft 123 and the eccentric shaft coupling portion 126 to be coupled to each other.

A piston coupling portion 127 may be disposed in a ring shape at the other end portion of the connecting rod 125. The piston coupling portion 127 is configured to surround a connecting pin 128 to be described later. The connecting pin 128 may be coupled to an inner side of a piston 138. The connecting pin 128 may be connected to the piston coupling portion 127 to pass through the piston coupling portion 127 in an up-down direction. The connecting rod 125 may be coupled to the piston 138.

Through this, the eccentric shaft 123 may rotate together with the crankshaft 119 around the crankshaft 119. The connecting rod 125 may convert a rotational motion of the eccentric shaft 123 into a reciprocating motion of the piston 138.

The compression unit 130 may be configured to include the cylinder block 131 and the piston 138.

The cylinder bock 131 may be disposed on an upper side of the drive motor 110. The cylinder block 131 is coupled to an upper portion of the stator 111 of the drive motor 110 to be elastically supported by the housing 100.

The cylinder block 131 may be configured to include a frame 132, a stator coupling portion 133, a shaft support portion 135, and a cylinder 136.

The frame 132 may be disposed to extend in a horizontal direction crossing an axial direction. The frame 132 may be disposed in a flat shape.

The stator coupling portion 133 may be disposed to protrude downward from an edge of the frame 132 toward the stator 111. The stator coupling portion 133 may be fastened to the stator 111 by the fastening member 150. The cylinder block 131 may be fastened to the stator 111 by the fastening member 150 passing through the stator coupling portion 133.

Through this, the cylinder block 131 may be elastically supported by the lower housing 102 together with the stator 111.

The shaft support portion 135 may extend axially from a central portion of the frame 132. A shaft receiving hole may be disposed on an inner side of the shaft support portion 135 to pass axially therethrough.

The crankshaft 119 may be coupled to the shaft support portion 135 through the shaft receiving hole so as to be rotatably mounted inside the frame 132.

A journal bearing may be disposed or omitted between an inner peripheral surface of the shaft support portion 135 and an outer peripheral surface of the crankshaft 119. The journal bearing may be disposed in a cylindrical shape. An inner peripheral surface of the journal bearing is configured to surround an outer peripheral surface of the crankshaft 119.

The inner peripheral surface of the journal bearing may be in surface contact with the outer peripheral surface of the crankshaft 119. The inner peripheral surface of the shaft support portion 135 is configured to surround the outer peripheral surface of the journal bearing. The inner peripheral surface of the journal bearing and the inner peripheral surface of the shaft support portion 135 may be in surface contact with each other.

Through this, the journal bearing may support the crankshaft 119 so as to allow the crankshaft 119 to rotate with respect to the shaft support portion 135. The journal bearing may limit the crankshaft 119 from being moved in a radial direction.

The journal bearing may be relatively inexpensive compared to a conventional ball bearing, thereby greatly contributing to cost improvement. In this embodiment, the journal bearing may be omitted. However, an oil layer may be formed between the inner peripheral surface of the shaft support portion 135 and the outer peripheral surface of the crankshaft 119. Through this, the shaft support portion 135 may perform the role of a journal bearing.

An oil passage 120 is disposed inside the crankshaft 119. An oil passage groove 121 may be disposed in a spiral direction on the outer peripheral surface of the crankshaft 119. The oil passage groove 121 may be connected in communication with the oil passage 120.

An oil pump 122 may be provided at a lower end portion of the crankshaft 119. An upper end portion of the oil pump 122 may be connected in communication with the oil passage 120 of the crankshaft 119. A lower end portion of the oil pump 122 may be disposed to sink in the oil stored in the lower housing 102.

Through this, the oil pump 122 may pump oil, and supply it to the inner peripheral surface of the shaft support portion 135 through the oil passage 120 and oil passage groove 121 of the crankshaft 119.

The shaft support portion 135 may be received into a second shaft hole of the rotor core 116. The second shaft hole may be disposed to have a large diameter at an upper end of the first shaft hole of the rotor core 116.

The second shaft hole may receive at least a part of the shaft support portion 135. The second shaft hole may be disposed to have a step radially outward from the first shaft hole. The second shaft hole may be located at an upper portion of the rotor core 116. A gap may be formed between an inner peripheral surface of the second shaft and an outer peripheral surface of the shaft support portion 135.

Through this, the rotor core 116 may rotate with respect to the shaft support portion 135.

The cylinder 136 is provided on one edge of the frame 132. The cylinder 136 may be disposed eccentrically, radially outward from the center of the frame 132.

A cylindrical hollow portion is disposed on an inner side of the cylinder 136. The cylinder 136 may extend radially with respect to the crankshaft 119. The hollow portion may be disposed to pass through the housing 100 in a front-rear direction. The hollow portion may pass radially through a central portion of the frame 132.

The piston 138 may be received into the cylinder 136. A rear side of the piston 138 may be disposed to have an open structure, and a front side of the piston 138 may be disposed to have a closed structure. Here, the front side of the piston 138 is disposed to face an opposite direction of the connecting rod 125 to be described later, and the rear side of the piston 138 is disposed to face the connecting rod 125.

A connecting pin 128 may be provided on the rear side of the piston 138. The connecting pin 128 may be coupled to the piston coupling portion 127 of the connecting rod 125. Through this, the piston 138 may receive a driving force from the drive motor 110 through the connecting rod 125.

A valve assembly 140 may be coupled to a front side of the cylinder 136. The front side of the cylinder 136 is disposed to face an opposite direction to the connecting rod 125. The front side of the piston 138 may form a compression chamber 137 inside the cylinder 136 together with the valve assembly 140.

A suction/discharge unit may be configured to include a valve assembly 140, a suction muffler 145, and a discharge muffler 147. The valve assembly 140 and the suction muffler 145 may be sequentially coupled from an outer opening end of the cylinder 136.

The valve assembly 140 may include a valve plate 141, a suction valve 142, a discharge valve 143, and a discharge cover 144.

The valve plate 141 is provided to cover a front opening surface of the compression chamber 137. The valve plate 141 may be fastened to the cylinder block 131.

The valve plate 141 may be provided with a suction port and a plurality of discharge ports. The suction port may be disposed to pass through a central portion of the valve plate 141. The discharge ports may be discharged to pass through the periphery of the suction port. The plurality of discharge ports may be disposed to be spaced apart from one another at a preset distance along a peripheral circumference of the suction port.

The suction valve 142 may be rotatably mounted on a rear side of the valve plate 141 toward the piston 138. The suction valve 142 is configured to open and close the suction port. The suction valve 142 may be elastically deformed according to a pressure difference between the compression chamber 137 and a discharge chamber to be described later.

The discharge valve 143 may be rotatably mounted on a front side of the valve plate 141 to face an opposite direction to the piston 138. The discharge valve 143 is configured to open and close the discharge port. The discharge valve 143 may be elastically deformed according to a pressure difference between the compression chamber 137 and a discharge chamber to be described later.

The suction valve 142 and the discharge valve 143 may be selectively opened and closed in opposite directions. During a suction stroke of the piston 138, the suction valve 142 may be opened and the discharge valve 143 may be closed.

Alternatively, during a discharge stroke of the piston 138, the suction valve 142 may be closed and the discharge valve 143 may be opened.

The discharge cover 144 may be fastened to an outer opening end portion of the cylinder block 131 to cover the compression chamber 137. A discharge chamber may be disposed to be recessed into the discharge cover 144.

The suction muffler 145 may be disposed to have a suction space thereinside. An inlet of the suction muffler 145 may be connected in communication with the suction pipe 146, and an outlet of the suction muffler 145 may be connected in communication with a suction side of the valve assembly 140.

The suction muffler 145 may be fixed to the valve assembly 140. The suction muffler 145 may be connected in communication with a suction port of the valve plate 141. The suction muffler 145 may transmit refrigerant sucked through the suction pipe 146 to the compression chamber 137 of the cylinder 136.

The discharge muffler 147 may be provided to be separated from the cylinder block 131. The discharge muffler 147 may have a discharge space disposed thereinside. An inlet of the discharge muffler 147 may be connected in communication with a discharge side of the valve assembly 140.

An operation process of the compressor will be described as follows.

When power is applied to the stator coil 114, a magnetic field is generated around the coil. The stator 111 and the rotor 115 interact electromagnetically to allow the rotor 115 to rotate with respect to the stator 111.

The crankshaft 119 rotates together with the rotor 115. One side of the connecting rod 125 is coupled to the eccentric shaft 123 of the crankshaft 119 to rotate along an orbiting motion of the eccentric shaft 123. The other side of the connecting rod 125 is coupled to the piston 138 so as to move forward and backward in a radial direction of the crankshaft 119.

The piston 138 may reciprocate in a front-rear direction inside the cylinder 136. When the piston 138 moves backward in the cylinder 136, a volume of the compression chamber 137 expands and a pressure in the compression chamber 137 decreases. The refrigerant filled in the suction muffler 145 passes through the suction valve 142 of the valve assembly 140 to be sucked into the compression chamber 137.

Conversely, when the piston 138 moves forward in the cylinder 136, the volume of the compression chamber 137 is compressed and the pressure increases. The refrigerant filled in the compression chamber 137 is compressed, and the discharge valve 143 of the valve assembly 140 is opened to allow the refrigerant to be discharged into the discharge chamber of the discharge cover 144.

The discharged refrigerant moves to the discharge space of the discharge muffler 147 through a loop pipe 149 and then passes through the loop pipe 149 and discharge pipe 148 to be discharged to a refrigeration cycle, repeating a series of processes.

However, as the piston 138 reciprocates by receiving power from the drive motor 110 transmitted through the connecting rod 125 in the compression chamber 137 of the cylinder 136, vibration occurs in the compression unit 130 and the motor unit. The vibration may cause a collision between components.

For example, the fastening member 150 that fastens the cylinder block 131 of the compression unit 130 and the stator 111 of the motor unit may be elastically supported by the spring 103 to suppress the vibration from being transmitted to the housing 100, but a collision between the cylinder block 131 and the stator 111 and the housing 100 cannot be avoided.

The present disclosure provides a structure of the damper 153 that can minimize vibrations of the cylinder block 131 and the stator 111 from being transmitted to the housing 100.

The damper 153 may be mounted on the fastening member 150. A plurality of fastening members 150 may be arranged on edges of the stator 111 and the cylinder block 131. In this embodiment, it shows a state in which the fastening member 150 is provided in four pieces.

The dampers 153 may be provided on front and rear sides of the cylinder block 131, respectively. In this embodiment, it shows a state in which the damper 153 is disposed on a rear side of the cylinder block 131 and disposed at a distance from a rear side of the housing 100.

In this embodiment, the damper 153 may be named a rear damper in that it is disposed close to a rear side surface of the housing 100 at a rear side of the cylinder block 131.

The fastening member 150 may be coupled to the stator 111 and the stator coupling portion 133 of the cylinder block 131 to pass axially therethrough. The first through hole 113 is disposed on an inner side of the stator core 112 to allow the fastening member 150 to be fastened thereto. The second through hole 134 is disposed inside the stator coupling portion 133. The first through hole 113 and the second through hole 134 are disposed to correspond to each other in an axial direction.

The fastening member 150 may extend to protrude outward from the cylinder block 131 through the first through hole 113 and the second through hole 134. An insertion portion 151 is provided at one end portion of the fastening member 150 protruding from an upper side of the cylinder block 131. The damper 153 may be mounted on the insertion portion 151.

The fastening member 150 may be formed of an iron-based material. Through this, the fastening member 150 may have a sufficient strength to support the damper 153.

The damper 153 may be made of a material different from that of the fastening member 150. For example, the damper 153 may be made of an elastic material such as rubber. Through this, the damper 153 may protect the compression unit 130 and the motor unit provided inside the housing 100 from external impact when colliding with the housing 100.

The damper 153 may be press-fitted into and coupled to the insertion portion 151 of the fastening member 150. The damper 153 may be disposed in a cylindrical shape. A receiving portion 154 is provided to receive the insertion portion 151 inside the damper 153. The insertion portion 151 may be disposed in a cylindrical shape. The receiving portion 154 may be disposed in a cylindrical shape.

The receiving portion 154 may be disposed to be recessed along an axial direction in the center of the damper 153.

The receiving portion 154 has a diameter corresponding to a diameter of the insertion portion 151. For example, a diameter (inner diameter) of the receiving portion 154 may be disposed to be slightly smaller than or equal to that (outer diameter) of the insertion portion 151. Through this, the insertion portion 151 may be press-fitted into and coupled to the receiving portion 154.

The damper 153 may include a first surface, a second surface, and an outer peripheral surface. The first and second surfaces may be respectively disposed as flat surfaces. The first surface may be disposed to face the cylinder block 131. The first surface may be disposed to be in contact with an upper surface of the cylinder block 131.

The first surface is located on a lower side of the damper 153. The first surface may be named a lower surface.

The second surface may be disposed to face an upper side surface on an inner side surface of the housing 100. The second surface may be disposed to face the first surface. The second surface may be disposed to be spaced apart at a preset distance from an upper side surface of the housing 100.

A thickness B of the damper 153 may be disposed between first and second surfaces of the damper 153. The second surface is located on an upper side of the damper 153. The second surface may be named an upper surface An outer peripheral surface of the damper 153 may be extend axially to connect the first and second surfaces of the damper 153. The outer peripheral surface of the damper 153 is a curved surface extending in a circumferential direction.

A height B of the damper 153 refers to a distance A to the second surface of the damper 153 with respect to the upper surface of the cylinder block 131.

The height B of the damper 153 may be disposed to be greater than or equal to a distance A between the upper side surface of the housing 100 and the second surface of the damper 153. In this embodiment, it shows a state in which the height B of the damper 153 is greater than a distance A between the upper side surface of the housing 100 and the upper surface of the damper 153.

Through this, a forced fit between the damper 153 and the fastening member 150 may be loosened, and thus even if the damper 153 moves upward from the fastening member 150, the second surface of the damper 153 may be caught on the housing 100 so as to prevent it from being disengaged from the fastening member 150.

The damper 153 may further include an anti-separation protrusion 155. The anti-separation protrusion 155 may be disposed to protrude downward from the second surface of the damper 153. The receiving portion 154 may extend to be recessed from the first surface of the damper 153 toward the second surface thereof.

The anti-separation protrusion 155 may extend in a circumferential direction around the receiving portion 154. The anti-separation protrusion 155 may be disposed in a conical shape. A communication hole is disposed in a central portion of the anti-separation protrusion 155 to communicate with the receiving portion 154.

A first tapered portion 1551 may be disposed to be inclined on an outer peripheral surface of the anti-separation protrusion 155. The first tapered portion 1551 may extend in a circumferential direction.

An anti-separation groove 156 may be disposed to be recessed downward on an upper surface of the cylinder block 131. The anti-separation groove 156 may receive the anti-separation protrusion 155. The anti-separation groove 156 may be disposed to have a shape and size corresponding to the anti-separation protrusion 155.

The anti-separation protrusion 155 may be inserted into and coupled to the anti-separation groove 156. Through this, the damper 153 may be tightly coupled to the stator coupling portion 133 of the cylinder block 131. The anti-separation protrusion 155 may prevent movement on an upper surface of the damper 153 and the cylinder block 131.

The anti-separation protrusion 155 may firmly maintain a coupling and assembly state between the damper 153 and the cylinder block 131.

The stator coupling portion 133 may constitute an edge of the cylinder block 131 when machining the second through hole 134 to fasten the fastening member 150. Through this, the damper 153 may avoid a collision between the stator coupling portion 133 constituting the edge of the cylinder block 131 and the housing 100.

A second tapered portion 157 may be disposed to be inclined on an inner peripheral surface of the receiving portion 154. The second tapered portion 157 may extend in a circumferential direction along an inner peripheral surface of the receiving portion 154.

A point at which the second tapered portion 157 begins to form in the receiving portion 154 may be a lower portion of the receiving portion 154. A point at which the formation of the second tapered portion 157 is completed may be an inner side end of the anti-separation protrusion 155. A point at which the formation of the second tapered portion 157 is completed may be a lower end of the receiving portion 154.

The second tapered portion 157 may be formed such that its diameter decreases from the lower portion of the receiving portion 154 toward the lower end of the receiving portion 154 or the inner side end of the anti-separation protrusion.

The receiving portion 154 may have a first diameter that is smaller than or equal to the diameter of the insertion portion 151. The second tapered portion 157 may have a second diameter smaller than the first diameter of the receiving portion 154.

Through this, the receiving portion 154 and the second tapered portion 157 may constitute a two-stage press-fit structure of the damper 153. An upper portion of the insertion portion 151 of the fastening member 150 may be one-stage press-fitted into the receiving portion 154, and a lower portion of the insertion portion 151 of the fastening member 150 may be two-stage press-fitted into the second tapered portion 157.

The second tapered portion 157 may have a diameter smaller than that of the receiving portion 154, and thus a lower portion of the insertion portion 151 of the fastening member 150 may be tightened more than an upper portion of the insertion portion 151.

A chamfer 152 may be disposed at one end of the insertion portion 151, for example, at an upper end portion of the insertion portion 151. The chamfer 152 may be disposed to be inclined with respect to an axial direction. The chamfer 152 may be disposed such that its diameter decreases toward an end of the insertion portion 151. The chamfer 152 may extend along a circumferential direction of the fastening member 150.

The receiving portion 154 may further include a buffer space portion 158 at an inner upper end portion thereof. The buffer space portion 158 may constitute a separation space between the damper 153 and the insertion portion 151. Through this, the buffer space portion 158 may constitute a space that can avoid contact with a sharp end of a bolt. The buffer space portion 158 may prevent the damper 153 from being torn or damaged due to a collision between the damper 153 and the housing 100 during the movement of the motor unit and the compression unit 130.

The damper 153 may further include an inclined portion 159. The inclined portion 159 may be disposed to be inclined with respect to an axial direction. The inclined portion 159 may be disposed at an upper end portion of the receiving portion 154. The inclined portion 159 may be provided in the buffer space portion 158.

The inclined portion 159 may be disposed to be inclined to correspond to the chamfer 152 of the insertion portion 151 of the fastening member 150. The inclined portion 159 may be disposed to be spaced apart at a distance from or in contact with the chamfer 152. In this embodiment, it shows a state in which the inclined portion 159 is spaced apart at a distance from the chamfer 152 to constitute the buffer space portion 158.

The damper 153 may further include a stress distribution hole. The stress distribution hole may be disposed to pass through an upper portion of the damper 153. The stress distribution hole may be connected in communication with the receiving portion 154. The stress distribution hole may be disposed in a cylindrical shape.

Through this, the stress distribution hole may distribute the stress of the damper 153 when the damper 153 and the housing 100 collide. In addition, the stress distribution hole may suppress the stress concentration of the damper 153 when the damper 153 and the housing 100 collide.

Figure 6:
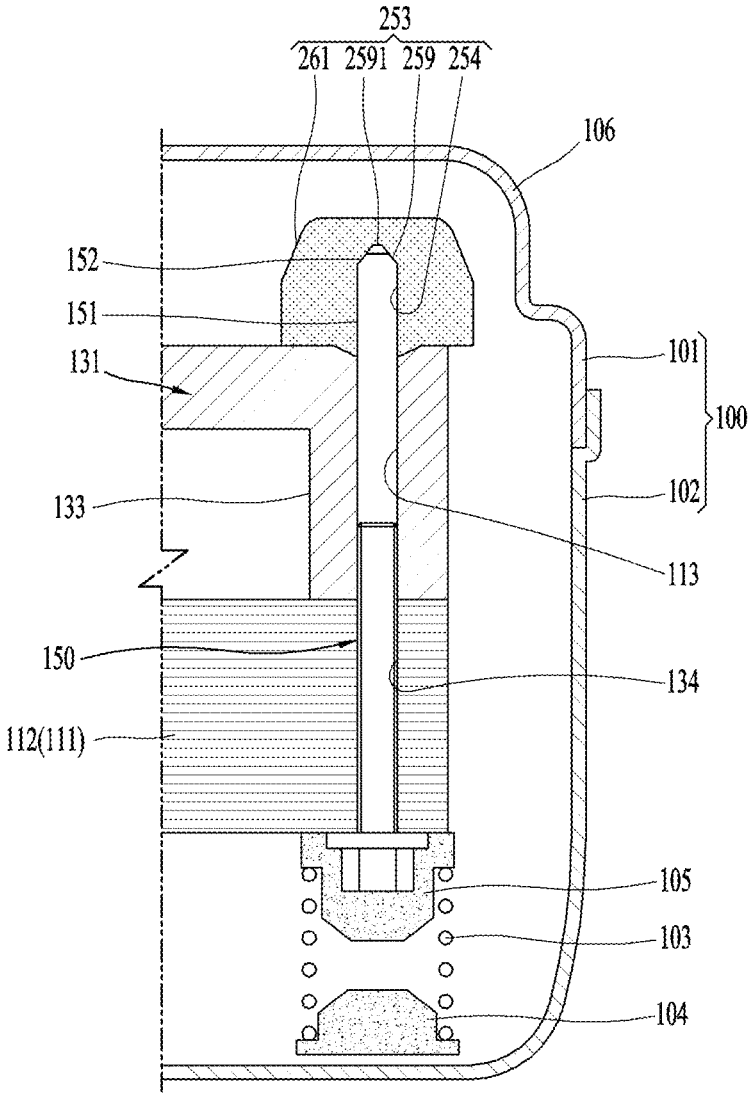
FIG. 6 is a conceptual view showing a state in which a receiving portion of the damper in FIG. 3 is in contact with an end of a bolt.

FIG. 6 is a conceptual view showing a state in which the receiving portion 254 of the damper 253 in FIG. 3 is in contact with an end of a bolt.

Figure 7:
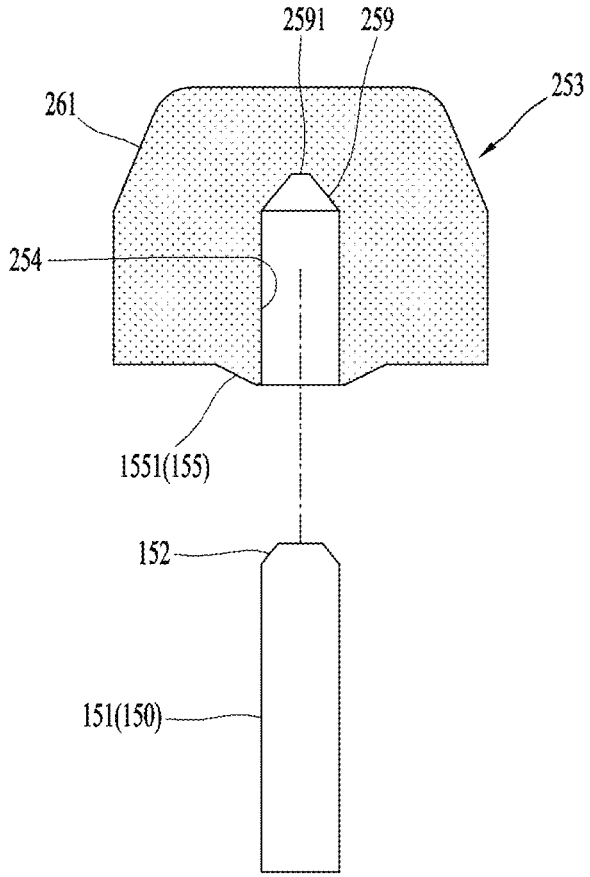
FIG. 7 is a conceptual view showing a state in which the damper and the fastening member are separated from each other in FIG. 6.

FIG. 7 is a conceptual view showing a state in which the damper 253 and the fastening member 150 are separated from each other in FIG. 6.

Figure 8:
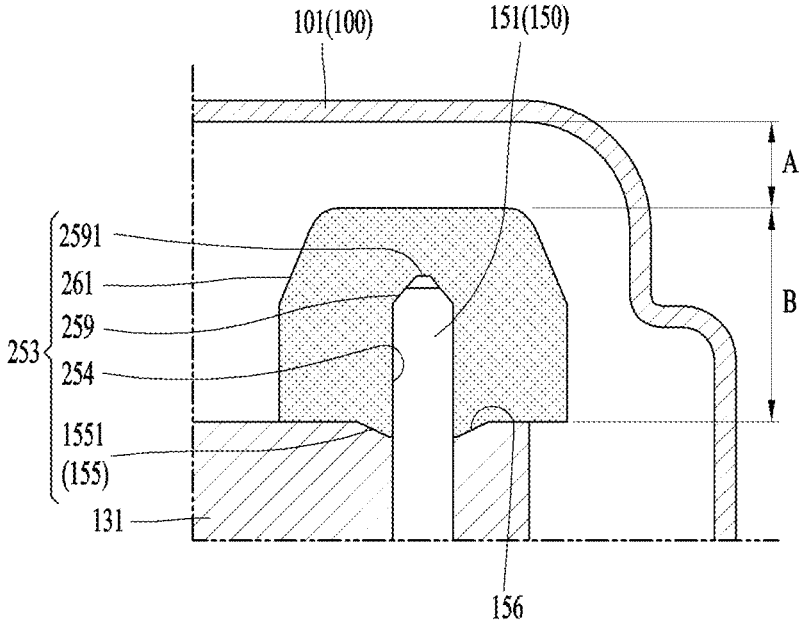
FIG. 8 is a conceptual view showing a state in which a height of the damper in FIG. 7 is greater than a distance between an upper surface of the damper and an inner side surface of the housing.

FIG. 8 is a conceptual view showing a state in which a height B of the damper 253 in FIG. 7 is greater than a distance between an upper surface of the damper 253 and an inner side surface of the housing 100.

This embodiment is different from the foregoing embodiments of FIGS. 1 to 5 in that the receiving portion 254 of the damper 253 is press-fitted so as to be in contact with an end of the fastening member 150.

An inclined portion 259 is disposed to be inclined at an upper end of the receiving portion 254 of the damper 253. A part of the inclined portion 259 may be disposed to be in contact with the chamfer 152 disposed to be inclined at an upper end portion of the fastening member 150.

Through this, the inclined portion 259 may be in contact with the chamfer 152 so as to prevent damage such as tearing of the damper 253 due to collision between the damper 253 and the housing 100 during the movement of the compression unit 130.

An uppermost end portion 2591 may be provided at an upper end of the inclined portion 259. The uppermost end portion 2591 of the inclined portion 259 may be disposed as a flat surface. Another part of the inclined portion 259 may not be in contact with the chamfer 152. The uppermost end portion 2591 of the inclined portion 259 may be disposed to be spaced apart from an upper end portion of the chamfer 152 in an up-down direction.

Through this, when an upper surface of the damper 253 collides with an inner side surface of the housing 100 in an up-down direction, the upper surface of the damper 253 may be compressed by external impact.

An upper thickness T of the damper 253 is smaller than a radial width W of the damper 253. The radial width W of the damper 253 is relatively larger than the upper thickness T of the damper 253.

The upper thickness T of the damper 253 is disposed between the uppermost end portion 2591 of the inclined portion 259 of the damper 253 and a second surface of the damper 253. The radial width W of the damper 253 refers to a radial width W between an inner peripheral surface of the receiving portion 254 and an outer peripheral surface of the damper 253 based on a radial center of the damper 253.

When an upper portion of the damper 253 collides with an inner side surface of the housing 100, as the chamfer 152 of the fastening member 150 moves upward along the inclined portion 259 of the damper 253, the damper 253 may absorb impact.

This embodiment differs from the foregoing embodiments of FIGS. 1 to 5 in that the stress distribution hole is omitted at an upper portion of the damper 253. Through this, the upper portion of the damper 253 may reinforce the rigidity of the damper 253 by filling the stress distribution hole.

In this embodiment, a diameter of the damper 253 may be disposed to be larger than that of the damper 253 according to the foregoing embodiments of FIGS. 1 to 5.

Through this, a radial width W between the receiving portion 254 of the damper 253 and an outer peripheral surface thereof may be increased, thereby preventing damage such as tearing of the damper 253.

An inclined surface may be further provided between the second surface and the outer peripheral surface of the damper 253. The inclined surface of the damper 253 may be disposed to be inclined at a preset angle with respect to the outer peripheral surface of the damper 253. The inclined surface of the damper 253 may extend in a circumferential direction of the damper 253.

A curved portion 106 may be disposed between an upper side surface and a rear side surface of the inner side surface of the housing 100. The curved portion 106 may be disposed to be curved at a preset curvature. The inclined surface of the damper 253 may be in non-contact with an inner side surface of the housing 100 even when the cylinder block 131 moves in any one of up-down, front-rear, and left-right directions.

Through this, even if the second surface of the damper 253 collides with the upper side surface of the housing 100 or the outer peripheral surface of the damper 253 collides with the rear side surface of the housing 100, the inclined surface of the damper 253 may be in non-contact with the inner peripheral surface of the housing 100, thereby minimizing damage such as tearing of the damper 253.

The compression unit 130 and the drive motor 110 may constitute a compressor body.

The damper 253 may limit, when there is an excessive movement of the compressor body, the movement of the compressor body by being first in contact with the inner side surface of the housing 100.

The housing 100 may be positioned at a preset distance from the compressor body, and the damper 253 may limit the movement of the compressor body to protect the compressor body from damage caused by impact.

Figure 9:
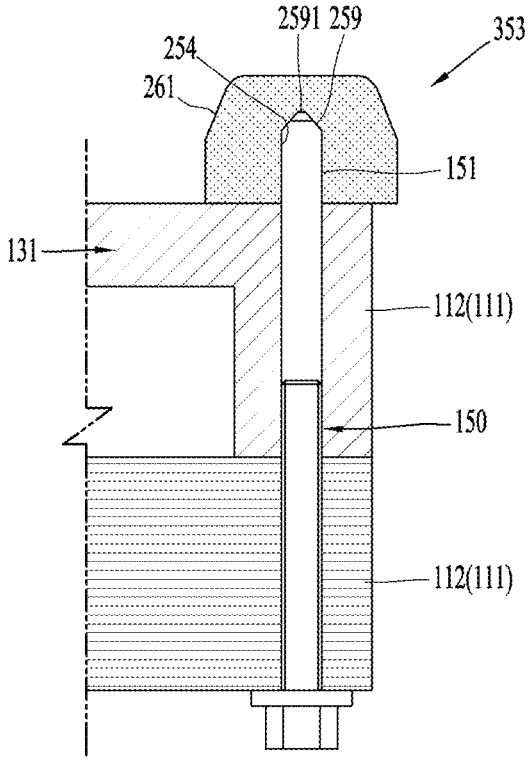
FIG. 9 is a conceptual view showing a state in which an anti-separation protrusion is omitted from a lower surface of the damper in FIG. 6.

FIG. 9 is a conceptual view showing a state in which the anti-separation protrusion 155 is omitted from a lower surface of a damper 353 in FIG. 6.

This embodiment differs from the foregoing embodiments of FIGS. 1 to 8 in that the anti-separation protrusion 155 protruding from the lower surface of the damper 353 is removed.

In this embodiment, it shows a state in which the first tapered portion 1551 of the anti-separation protrusion 155 of the damper 353 and the second tapered portion 157 of the receiving portion 254 of the damper 353 are omitted.

Since other elements are the same or similar to the embodiments of FIGS. 1 to 8, a redundant description will be omitted.

Figure 10:
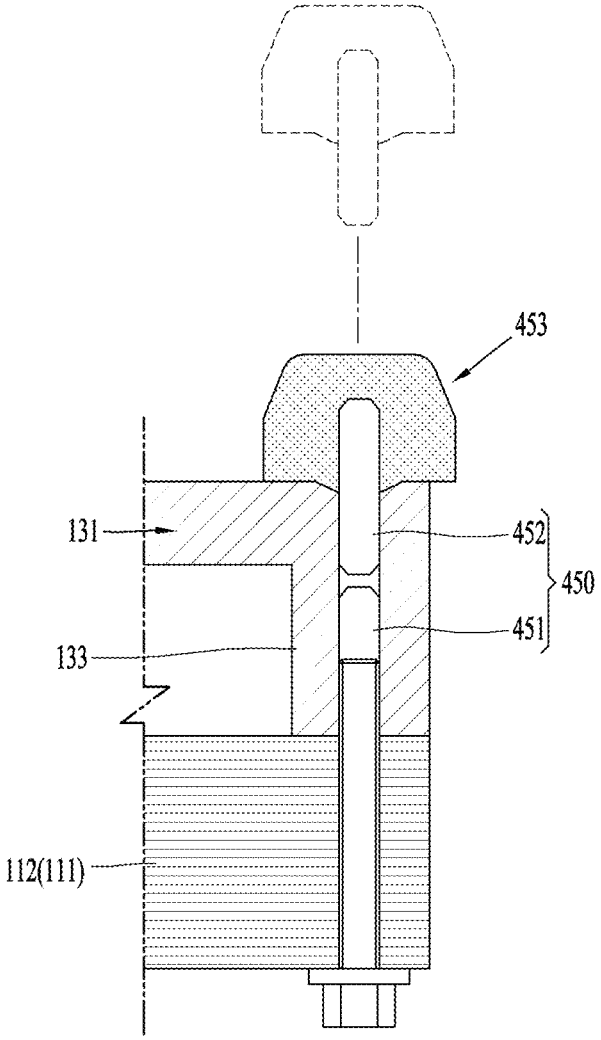
FIG. 10 is a conceptual view showing a state in which a damper is not directly assembled to a fastening member of a stator, but the damper is fastened to a cylinder block by adding a separate fastening member.

FIG. 10 is a conceptual view showing a state in which a damper 453 is not directly assembled to a fastening member 450 of the stator 111, but the damper 453 is fastened to the cylinder block 131 by adding a separate fastening member 450.

In this embodiment, the damper 453 is not directly assembled to the stator 111 and a first fastening member 451 of the cylinder block 131, but a second fastening member 452 integrated with the damper 453 may be fastened to the cylinder block 131 by adding the separate second fastening member 452.

The fastening member 450 may include a first groove 451 and a second groove 452. The first fastening member 451 and the second fastening member 452 may each be made of an iron-based material.

The first fastening member 451 may be implemented as a bolt. A length of the first fastening member 451 may extend to be longer than an axial length of the stator core 112 (or a stacking length of the stator core 112). The length of the first fastening member 451 may be smaller than a sum of the axial lengths of the stator core 112 and the stator coupling portion 133 of the cylinder block 131.

A part of the first fastening member 451 may pass through the first through hole 113 of the stator core 112, and another part of the first fastening member 451 may be received into the second through hole 134 of the stator coupling portion 133. Through this, the first fastening member 451 may fasten the stator 111 and the cylinder block 131.

The second fastening member 452 may be implemented in a form of a pin or a cylindrical bar. The second fastening member 452 may not have a screw portion formed. A length of the second fastening member 452 may be shorter than an axial length of the stator coupling portion 133 of the cylinder block 131.

The damper 453 may be integrally disposed with the second fastening member 452. For example, the damper 453 and the second fastening member 452 may be made of different materials.

A part of the second fastening member 452 may be inserted into and coupled to the receiving portion 254 of the damper 453. Another part of the second fastening member 452 may protrude from the receiving portion 254 of the damper 453.

The second fastening member 452 to which the damper 453 is integrally coupled may be press-fitted into and coupled to the second through hole 134 of the stator coupling portion 133 of the cylinder block 131.

Since other elements are the same or similar to the foregoing embodiments of FIGS. 1 to 9, a redundant description will be omitted.

Figure 11:
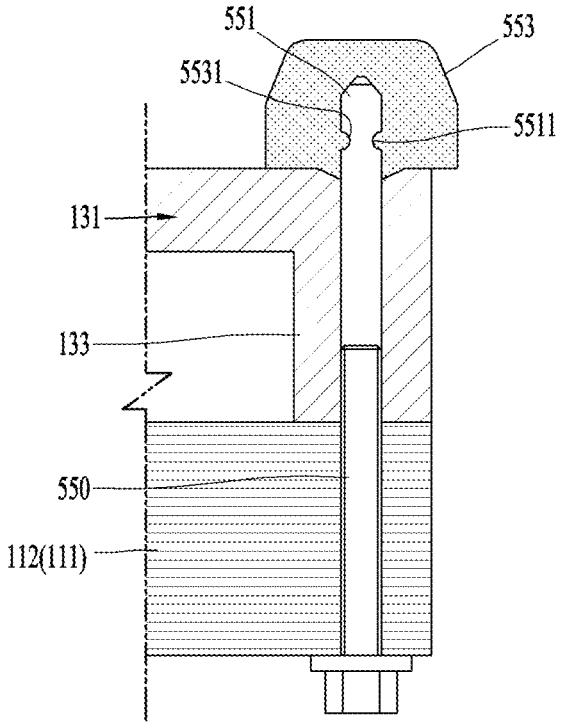
FIG. 11 is a conceptual view showing a state in which a coupling protrusion is provided in a receiving portion of the damper in FIG. 6 and a coupling groove is provided in an insertion portion of the fastening member.

FIG. 11 is a conceptual view showing a state in which a coupling protrusion 5531 is provided in the receiving portion 554 of the damper 553 in FIG. 6, and a coupling groove 5511 is provided in the insertion portion 551 of the fastening member 550.

In this embodiment, the coupling groove 5511 may be disposed to be recessed in a radial direction on an outer peripheral surface of the insertion portion 551 of the fastening member 550, and the coupling protrusion 5531 may be disposed to protrude in a radial direction toward the coupling groove 5511 on an inner peripheral surface of the receiving portion 554 of the damper 553.

The coupling protrusion 5531 of the damper 553 and the coupling groove 5511 of the fastening member 550 may be disposed in shapes corresponding to each other. For example, the coupling protrusion 5531 of the damper 553 and the coupling groove 5511 of the fastening member 550 may be disposed in a semicircular shape. However, the coupling protrusion 5531 and the coupling groove 5511 are not limited to a semicircular shape, and may be disposed in various shapes such as a polygon.

Through this, the coupling protrusion 5531 of the damper 553 may be coupled to the coupling groove 5511 of the fastening member 550, thereby preventing the damper 553 from being disengaged from the insertion portion 551 of the fastening member 550.

Since other elements are the same or similar to the foregoing embodiments of FIGS. 1 to 10, a redundant description will be omitted.

Figure 12:
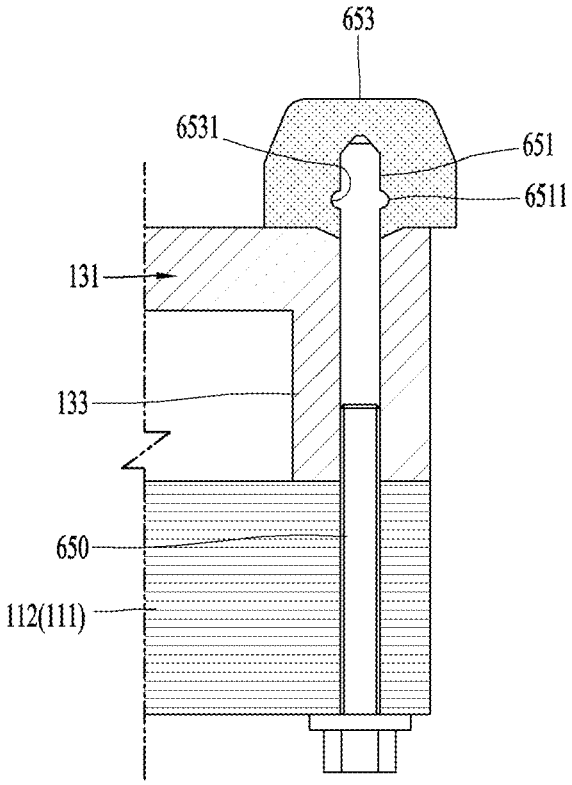
FIG. 12 is a conceptual view showing a state in which a coupling groove is provided in the receiving portion of the damper in FIG. 6 and a coupling protrusion is provided in the insertion portion of the fastening member.

FIG. 12 is a conceptual view showing a state in which a coupling groove 6531 is provided in the receiving portion 654 of the damper 653 in FIG. 6, and a coupling protrusion 6511 is provided in the insertion portion 651 of the fastening member 650.

In this embodiment, the coupling groove 6531 may be disposed to be recessed in a radial direction on an inner peripheral surface of the receiving portion 654 of the damper 653, and a coupling protrusion 6511 may be disposed to be protruded in a radial direction toward the coupling groove 6531 on an outer peripheral surface of the insertion portion 651 of the fastening member 650.

The coupling protrusion 6511 of the fastening member 650 and the coupling groove 6531 of the damper 653 may be disposed in shapes corresponding to each other. For example, the coupling protrusion 6511 of the fastening member 650 and the coupling groove 6531 of the damper 653 may be disposed in a semicircular shape. However, the shape of the coupling protrusion 6511 and the coupling groove 6531 is not limited to a semicircular shape and may be disposed in various shapes such as a polygon.

Through this, the coupling protrusion 6511 of the fastening member 650 may be coupled to the coupling groove 6531 of the damper 653, thereby preventing the damper 653 from being disengaged from the insertion portion 651 of the fastening member 650.

Since other elements are the same or similar to the foregoing embodiments of FIGS. 1 to 11, a redundant description will be omitted.

What is claimed is:

1. A compressor, comprising:

a housing;

a motor unit provided on an inner side of the housing, and provided with a crankshaft, a rotor coupled to the crankshaft, and a stator surrounding the rotor;

a compression unit including a cylinder block provided on the inner side of the housing, a piston disposed to be reciprocally movable inside the cylinder block, and a connecting rod connected to the crankshaft and the piston;

a fastening member coupled to the stator to pass through the cylinder block; and a damper mounted on one end portion of the fastening member protruding from the cylinder block, wherein the fastening member is a single member that passes through both the stator and the cylinder block to couple the stator and the cylinder block to each other, and the one end portion of the single fastening member is an insertion portion that extends beyond the cylinder block to directly support the damper without a separate support member.

2. The compressor of claim 1, wherein the fastening member is formed of an iron-based material, and wherein the damper is formed of a rubber material.

3. The compressor of claim 1, wherein the fastening member is implemented as a screw.

4. The compressor of claim 1, wherein the damper is spaced apart from an inner side surface of the housing by a preset distance in at least one of upward-downward, frontward-rearward, or lateral directions.

5. The compressor of claim 1, wherein the damper is a rear damper disposed on a rear side of the cylinder block in a direction away from the piston that moves such that refrigerant sucked into a compression chamber of the cylinder block is compressed.

6. The compressor of claim 1, wherein the housing comprises:

a first housing; and a second housing coupled to cover an upper portion of the first housing, and wherein the fastening member protrudes upward from one surface of the cylinder block, and wherein a height of the damper protruding from one surface of the cylinder block is greater than or equal to a distance between an upper surface of the damper and an inner side surface of the housing.

7. The compressor of claim 1, wherein a receiving portion is disposed inside of the damper into which the insertion portion is press-fitted.

8. The compressor of claim 7, wherein the fastening member further comprises a chamfer inclined at an end portion of the insertion portion, and wherein the damper further comprises a buffer space portion to surround the chamfer at a distance therefrom.

9. The compressor of claim 8, wherein the buffer space portion comprises:

an inclined portion in close contact with at least one side surface of the chamfer.

10. The compressor of claim 7, wherein a stress distribution hole is disposed at an upper portion of the damper so as to pass through toward the receiving portion.

11. The compressor of claim 7, wherein an anti-separation groove is disposed around the cylinder block from which the fastening member protrudes, and wherein an anti-separation protrusion protrudes from one surface of the damper in close contact with the cylinder block to be coupled to the anti-separation groove.

12. The compressor of claim 11, wherein a first tapered portion is disposed on an outer peripheral surface of the anti-separation protrusion inclined toward an inner side of the anti-separation groove, and wherein a second tapered portion is disposed on an inner peripheral surface of the receiving portion having a diameter that decreases toward the anti-separation groove.

13. The compressor of claim 1, wherein a coupling protrusion protrudes radially from an inner peripheral surface of the damper, and wherein a coupling groove is recessed on an outer peripheral surface of the fastening member so as to be coupled to the coupling protrusion.

14. The compressor of claim 1, wherein a coupling groove is radially recessed on an inner peripheral surface of the damper, and wherein a coupling protrusion protrudes from an outer peripheral surface of the fastening member so as to be coupled to the coupling groove.

15. A compressor, comprising:

a housing;

a motor unit provided on an inner side of the housing, and provided with a crankshaft, a rotor coupled to the crankshaft, and a stator surrounding the rotor;

a compression unit including a cylinder block provided on the inner side of the housing, a piston disposed to be reciprocally movable inside the cylinder block, and a connecting rod connected to the crankshaft and the piston;

a fastening member coupled to the stator to pass through the cylinder block; and a damper mounted on one end portion of the fastening member protruding from the cylinder block, wherein an anti-separation groove is disposed around the cylinder block from which the fastening member protrudes, and wherein an anti-separation protrusion protrudes from one surface of the damper in close contact with the cylinder block to be coupled to the anti-separation groove.

16. The compressor of claim 15, wherein a first tapered portion is disposed on an outer peripheral surface of the anti-separation protrusion inclined toward an inner side of the anti-separation groove, and wherein a second tapered portion is disposed on an inner peripheral surface of the receiving portion having a diameter that decreases toward the anti-separation groove.

* * * * *